US008245483B2

(12) United States Patent
Yuyama et al.

(10) Patent No.: US 8,245,483 B2
(45) Date of Patent: Aug. 21, 2012

(54) MEDICINE PACKAGING APPARATUS OF PACKAGING MEDICINE

(75) Inventors: Hiroyuki Yuyama, Toyonaka (JP); Tomohiro Sugimoto, Toyonaka (JP)

(73) Assignee: Yuyama Mfg. Co., Ltd., Osaka (JP)

( * ) Notice: Subject to any disclaimer, the term of this patent is extended or adjusted under 35 U.S.C. 154(b) by 0 days.

(21) Appl. No.: 13/110,648

(22) Filed: May 18, 2011

(65) Prior Publication Data

US 2011/0239587 A1 Oct. 6, 2011

Related U.S. Application Data

(62) Division of application No. 12/440,014, filed as application No. PCT/JP2007/066055 on Aug. 18, 2007, now Pat. No. 8,020,356.

(30) Foreign Application Priority Data

Sep. 5, 2006 (JP) ..... 2006-240284

(51) Int. Cl.
*B65B 19/28* (2006.01)

(52) U.S. Cl. ..... 53/52; 53/168

(58) Field of Classification Search ..... 53/52, 168, 53/237, 154, 411, 493, 495
See application file for complete search history.

(56) References Cited

U.S. PATENT DOCUMENTS 5,174,472 A 12/1992 Raque et al.
5,348,061 A 9/1994 Riley et al.
5,481,855 A 1/1996 Yuyama
5,678,393 A 10/1997 Yuyama et al.
5,787,678 A 8/1998 Koike et al.
6,202,385 B1 3/2001 Kim
6,212,853 B1 4/2001 Yuyama et al.
6,345,487 B1 2/2002 Luciano et al.
6,349,848 B1 2/2002 Uema et al.
6,644,504 B2 11/2003 Yuyama et al.

FOREIGN PATENT DOCUMENTS

JP 57-80403 5/1982

(Continued)

OTHER PUBLICATIONS

International Search Report for PCT/JP2007/066055, in English and Japanese, 4 pages (mailed Nov. 20, 2007).

(Continued)

*Primary Examiner* — Sameh H. Tawfik
(74) *Attorney, Agent, or Firm* — Jones Day

(57) ABSTRACT

There is provided a medicine packaging apparatus, which is capable of rapidly coping with errors occurring during processes. The medicine packaging apparatus includes: a medicine supply unit 1 for supplying a medicine according to prescription data; a medicine standby unit 11 for temporarily holding the medicine supplied by the medicine supply unit 1 and having the medicine stand by; a printing unit 2 for printing relevant data on a packaging paper according to the prescription data; a packaging paper conveyance unit for conveying a packaging paper 15; a medicine packaging unit 3 for packaging the medicine supplied by the medicine supply unit 1 into the packaging paper 15 in a packaging position; and a control unit 4 for allowing the packaging paper conveyance unit to convey a relevant portion of the packaging paper 15, on which the relevant data is printed by the printing unit 2, to the packaging position and allowing the medicine packaging unit to package the corresponding medicine standing by in the medicine standby unit 11.

2 Claims, 12 Drawing Sheets

FOREIGN PATENT DOCUMENTS

| | | |
|---|---|---|
| JP | 60-82130 | 5/1985 |
| JP | 8-20438 | 1/1996 |
| JP | 2768614 | 4/1998 |
| JP | 10-129603 | 5/1998 |
| JP | 11-147501 | 6/1999 |
| JP | 2942769 | 6/1999 |
| JP | 2000-6904 | 1/2000 |
| JP | 2000-185703 | 7/2000 |
| JP | 2000-325430 | 11/2000 |
| JP | 2005-162240 | 6/2005 |
| JP | 2005-263318 | 9/2005 |

OTHER PUBLICATIONS

European Search Report for EP 07792671.5-2308, 5 pages, dated Sep. 17, 2010, now patent No. EP 2067699.

MEDICINE PACKAGING APPARATUS OF PACKAGING MEDICINE

CROSS REFERENCE TO RELATED APPLICATIONS

This application is a divisional of U.S. patent application Ser. No. 12/440,014, filed Apr. 16, 2009, now U.S. Pat. No. 8,020,356 which is a 35 U.S.C. §371 national stage filing of International Application No. PCT/JP2007/066055, filed Aug. 18, 2007, which claims priority to Japanese Patent Application No. 2006-240284, filed Sep. 5, 2006, the entire contents of all of which are incorporated by reference herein.

TECHNICAL FIELD

The present invention relates to a medicine packaging apparatus and a method of packaging medicine.

BACKGROUND ART

There exists in the art a conventional medicine packaging apparatus, which is constructed to print a medicine name and a dosage method on a packaging paper for packaging a medicine (see, e.g., Patent Documents 1 and 2)

Patent Document 1: Japanese Patent Application Laid-Open No. 2000-185703

Patent Document 2: Japanese Patent Application Laid-Open No. 2005-263318

SUMMARY OF THE INVENTION

A conventional medicine packaging apparatus is designed to package a medicine after printing on a packaging paper. This is because printing cannot be permitted prior to packaging medicines since an ink ribbon-type printer or a dot-type printer for use in printing processes a packaging paper at its front or back face. Further, since a printing unit is provided in a printing position and a packaging unit is provided in a packaging position, both the printing and the packaging positions should be spaced apart to some extent due to a space which each of the units occupies. Specifically, a spacing corresponding to at least two or three packagings should be ensured. Thus, in case the medicines cannot be packaged according to the prescription data due to errors occurring during a packaging process, it is impossible to cope with such a case in that the printing is already completed. In some cases, there is a need to resume the packaging and printing processes associated with the prescription data from the beginning.

Further, descriptions to be printed on a packaging paper contain a medicine name, contents of a prescription, etc. However, they may not contain a use-by date, a lot number, etc. Generally, medicines are managed by means of lot numbers from a manufacturing point to a selling point. Thus, if a lot number is printed on a packaging paper, then the history of such a medicine can be examined based on the lot number (i.e., traceability). However, conventional apparatus do not have such a printing function. This is because as there are more printing items, more time is spent for a restoration work.

Thus, it is an object of the present invention to provide a medicine packaging apparatus and a medicine packaging method, which is capable of rapidly coping with errors that occur during processes.

A medicine packaging apparatus of the present invention, which is provided to solve the foregoing problems, comprises the following: a medicine supply means for supplying a medicine according to a prescription data; a medicine standby means for temporarily holding the medicine supplied by the medicine supply means and having the medicine stand by; a printing means for printing a relevant data on a packaging paper according to the prescription data; a packaging paper conveyance means for conveying the packaging paper; a medicine packaging means for packaging the medicine supplied by the medicine supply means into the packaging paper in a packaging position; and a control means for allowing the packaging paper conveyance means to convey a portion of the packaging paper, on which the relevant data is printed by the printing means, to the packaging position and allowing the medicine packaging means to package the corresponding medicine standing by in the medicine standby means.

According to such construction, although a printing position of the printing means and the packaging position of the medicine packaging means are spaced apart, descriptions to be printed and medicines to be packaged can be precisely correlated under an operation of the medicine standby means. Accordingly, it is possible to rapidly cope with error occurrences.

The apparatus may further comprise a medicine detecting means for detecting the medicine supplied to the medicine standby means by the medicine supply means. The control means may determine whether the medicine stands by in the medicine standby means based on a detection signal from the medicine detecting means.

According to such construction, prior to printing the packaging paper, the medicine detecting means detects whether the medicine is properly supplied from the medicine supply means based on the prescription data. Thus, it does not occur that printing is performed as error occurs. In such a case, the prescription is canceled and packaging is resumed. However, since printing is not completed, printing and packaging processes can be smoothly resumed.

The medicine standby means may include a passage opening and closing means for opening and closing a medicine passage extending from the medicine supply means to the medicine packaging means at any position.

Preferably, the passage opening and closing means may be provided in at least two places. One of the places may correspond to one packaging in a printing position of the packaging paper at the printing means. The other may correspond to one packaging in the packaging position of the packaging paper at the medicine packaging means.

According to such construction, while the packaging paper is printed in the printing position and is then conveyed to the packaging positions after the medicine is detected by the medicine detecting means, each of the passage opening and closing means is operated, thereby leading the medicine to the packaging position. That is, a conveyance operation of the medicine and a conveyance operation of the packaging paper can synchronize and the corresponding medicine can be accurately packaged in a position of the printed packaging.

Preferably, as to the passage opening and closing means, as many as or more than conveyance pitches of the packaging paper from a printing position of the packaging paper at the printing means to the packaging position of the packaging paper at the medicine packaging means may be provided.

According to such construction, the corresponding medicine can be accurately packaged in a position of the printed packaging as the conveyance operation of the medicine and the conveyance operation of the packaging paper synchronize, irrespective of the size or layout of each component member. Further, since the printing process can synchronize after ascertaining the dispensing of medicine supplied by the medicine supply means, the medicine corresponding to the printed descriptions can be packaged in each packaging position.

Preferably, the medicine supply means includes the following: medicine accommodating portions, each configured to accommodate one kind of a medicine; and a medicine collecting portion configured to collect the medicines supplied from each of the medicine accommodating portions to one place. The passage opening and closing means may be provided at the medicine collecting portion.

Preferably, the apparatus may further comprise a memory means for storing a data correlating to a position information of each of the medicine accommodating portions and a medicine information of the medicine accommodated in each of the medicine accommodating portions. The medicine information may include use-by dates of the medicines accommodated in the medicine accommodating portions. The control means may allow the printing means to print the use-by date of the medicine on the packaging paper with reference to the data stored in the memory means when the control means determines the medicine standing by in the medicine standby means to be appropriate based on a detection result from the medicine detecting means.

According to such construction, the packaging paper may be printed by the printing means only when the medicine standing by in the medicine standby means is appropriate. Since the printed descriptions contain the use-by date, any dosage beyond such a use-by date can be prevented.

Preferably, the apparatus may further comprise a memory means for storing a data correlating to a position information of each of the medicine accommodating portions and a medicine information of the medicine accommodated in each of the medicine accommodating portions. The medicine information may include lot numbers inherent to the medicines accommodated in the medicine accommodating portions. The control means may specify the medicine accommodating portion accommodating the relevant medicine with reference to the data of the memory means based on the prescription data and begin supplying the medicine while allowing the printing means to print the lot number of the medicine on the packaging paper.

According to such construction, the packaging paper can be printed by the printing means only when the medicine standing by in the medicine standby means is appropriate. Since the printed descriptions contain the lot number, tracing the packaged medicine afterward is possible based on such a lot number.

Preferably, the memory means may further store an error information. The control means may allow the printing means to print the error information on the packaging paper when the medicine based on the prescription data is not detected by the medicine detecting means.

According to such construction, since the error information can be printed on the packaging paper based on a detection result of the medicine just before packaging it, the printed descriptions can become highly reliable.

Further, a medicine packaging method of the present invention, which is provided to solve the foregoing problems, sequentially performs the following processes: a medicine supplying process for supplying a relevant medicine according to a prescription data; a medicine standby process for allowing the supplied medicine to temporarily stand by; a medicine detecting process for detecting the standing by medicine; a printing process for printing a packaging paper when the medicine based on the prescription data is detected; a conveying process for conveying the packaging paper; and a packaging process for supplying the temporarily standing by medicine to a printed portion of the packaging paper and packaging the medicine.

Preferably, the conveying process may be performed at conveyance pitches corresponding to the number of packaging of the packaging paper from a printing position in which the packaging paper is printed to a packaging position wherein the medicine is packaged in the packaging paper. The medicine may be packaged into the packaging paper after the medicine is sequentially moved to standby positions corresponding to the number of the conveyance pitches by the medicine standby process.

According to the present invention, the medicine supplied from the medicine supply means is temporarily kept in a standby state in the medicine standby means and printing the packaging paper is performed based on the detection result from the medicine detecting means. Thus, it does not occur that the printing becomes of no use due to error occurrence. In addition, a restoration work after error occurrence can be also rapidly performed.

DESCRIPTION OF REFERENCE NUMERALS

Figure 1:
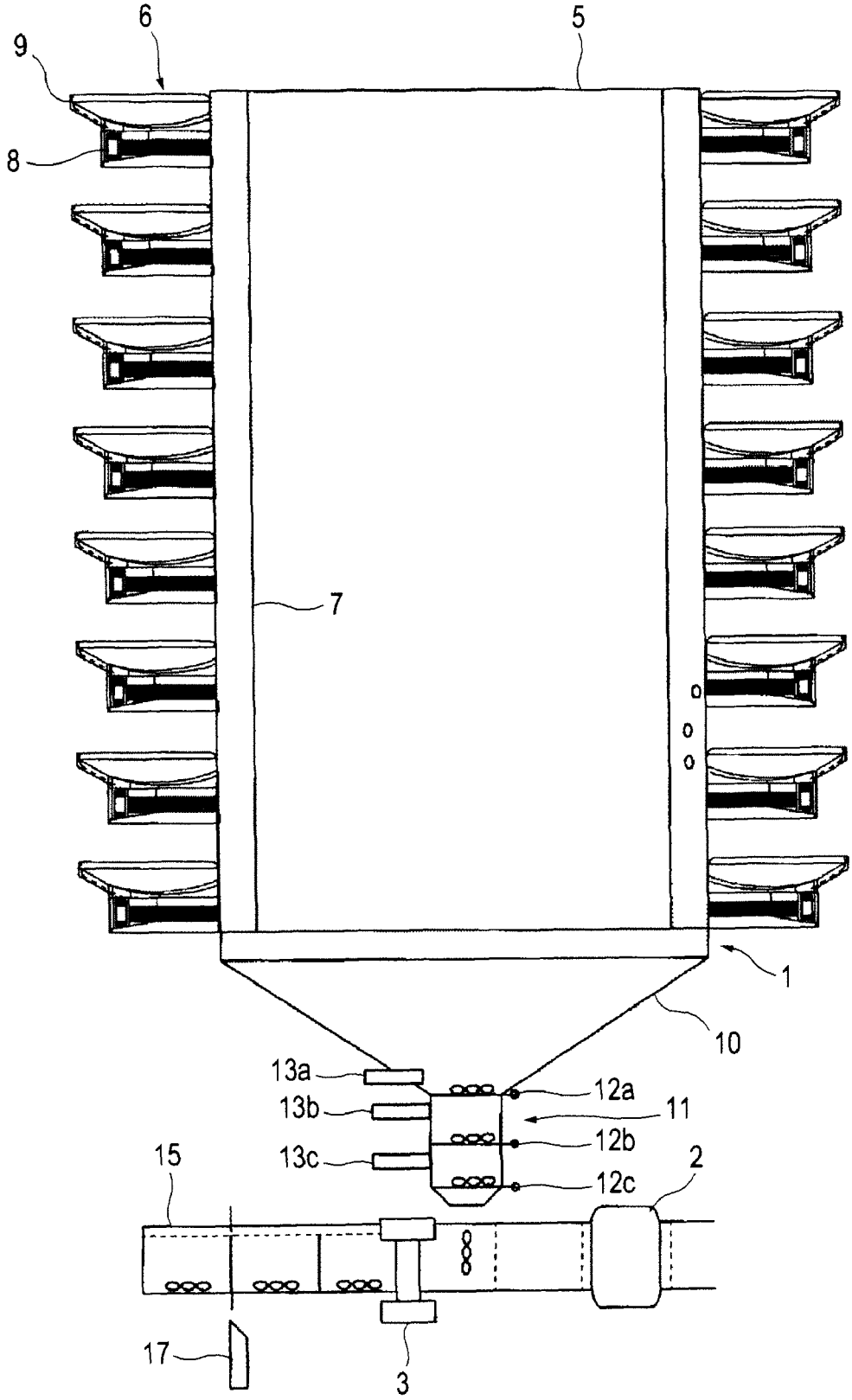
FIG. 1 schematically illustrates a tablet packaging apparatus according to one embodiment of the present invention.

1 . . . Tablet supply unit (medicine supply means)
2 . . . Printing unit (printing means)
3 . . . Packaging unit (medicine packaging means)
4 . . . Control unit (control means)
5 . . . Drum
6 . . . Tablet feeder
7 . . . Guide passage
8 . . . Motor base
9 . . . Tablet cassette
10 . . . Hopper
11 . . . Tablet standby portion (medicine standby means)
12*a*, 12*b*, 12*c* . . . Shutter (passage opening and closing means)

13*a*, 13*b*, 13*c* . . . Tablet detecting sensor (medicine detecting means)
14 . . . Roll
15 . . . Packaging paper
16 . . . Seal member
17 . . . Cutter
18 . . . Memory section
19 . . . Control section
20 . . . Tablet supply unit controlling section
21 . . . Tablet standby unit controlling section
22 . . . Printing and packaging unit controlling section

DETAILED DESCRIPTION

Embodiments of the present invention will be described with reference to the accompanying drawings.

FIG. 1 schematically illustrates a medicine packaging apparatus according to one embodiment of the present invention. The medicine packaging apparatus generally comprises a tablet supply unit 1 (medicine supply means), a printing unit 2 (printing means), a packaging unit 3 (packaging means) and a control unit 4 (control means).

The tablet supply unit 1 is constructed such that a plurality of tablet feeders 6 are vertically and circumferentially disposed on an outer periphery of the drum 5 having a generally cylindrical shape. Further, it is constructed such that a guide passage 7 for downwardly guiding tablets discharged from each of the tablet feeders 6 arranged in the vertical row is disposed at each of the vertical rows of the tablet feeders 6.

Figure 4:
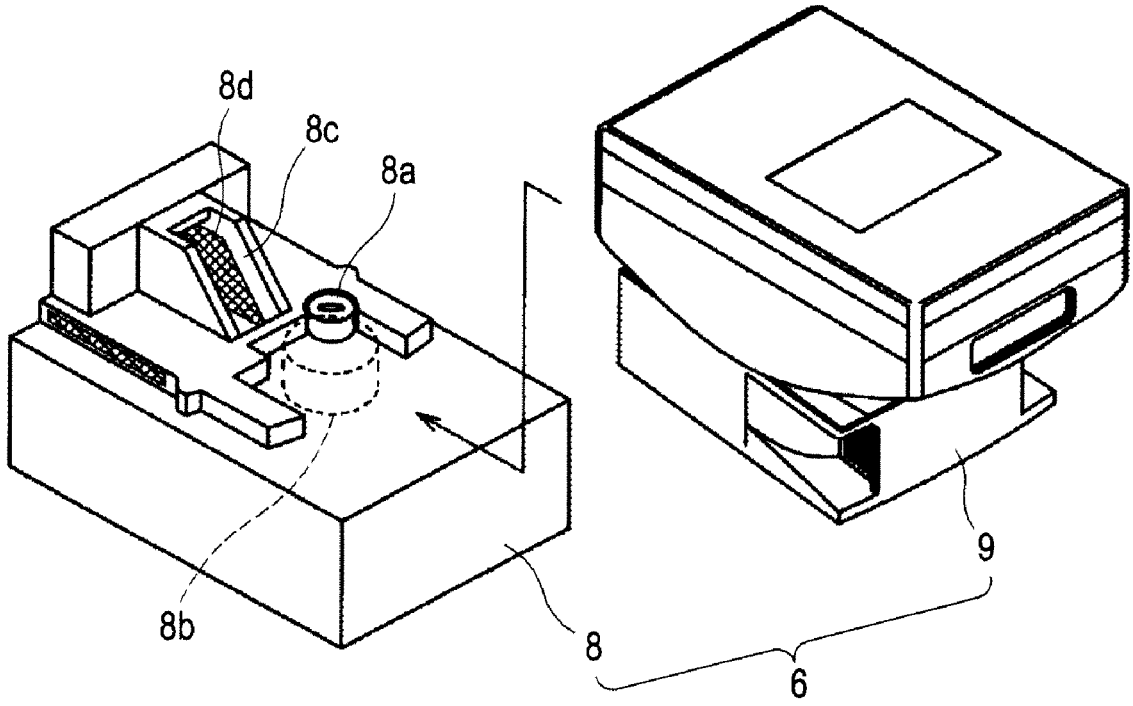
FIG. 4 is an exploded perspective view of a tablet feeder.

As shown in FIG. 4, the tablet feeder 6 is constructed so that a tablet cassette 9 is attachably and detachably mounted on a motor base 8. The tablet cassette 9 has a box-like shape of a general rectangular hexahedron. The tablet cassette 9 accommodates the same kind of tablets, which can be managed by means of a lot number. The tablet cassette 9 contains a rotor (not shown) and a plurality of pocket portions disposed thereabout. The tablets are held within each of the pocket portions one by one. The motor base 8 is constructed to transmit power from a motor 8*b* built therein to the tablet cassette 9 via a gear 8*a* when the tablet cassette 9 is mounted on the motor base 8. Further, the motor base 8 has a tablet passage 8*c*, through which the tablets held within the pocket portions are discharged in sequence in conjunction with a rotation of the rotor. A counting sensor 8*d* is mounted in the tablet passage 8*c* in order to count the quantity of the tablets passing therethrough. However, such counting sensor 8*d* does not need to be provided. A tablet detecting sensor, which will be described below, may be employed instead of the counting sensor 8*d*.

A hopper 10 is disposed beneath the drum 5, as shown in FIG. 1. The hopper 10 is configured to become gradually narrow in cross-section as it proceeds downwardly. A tablet standby portion 11 (medicine standby means) having a pail shape is provided at a lower end of the hopper 10. Thus, as the tablets are fed from the tablet supply unit 1, the tablets can be smoothly guided into the tablet standby portion 11 from any one of the guide passages 7.

Figure 2:
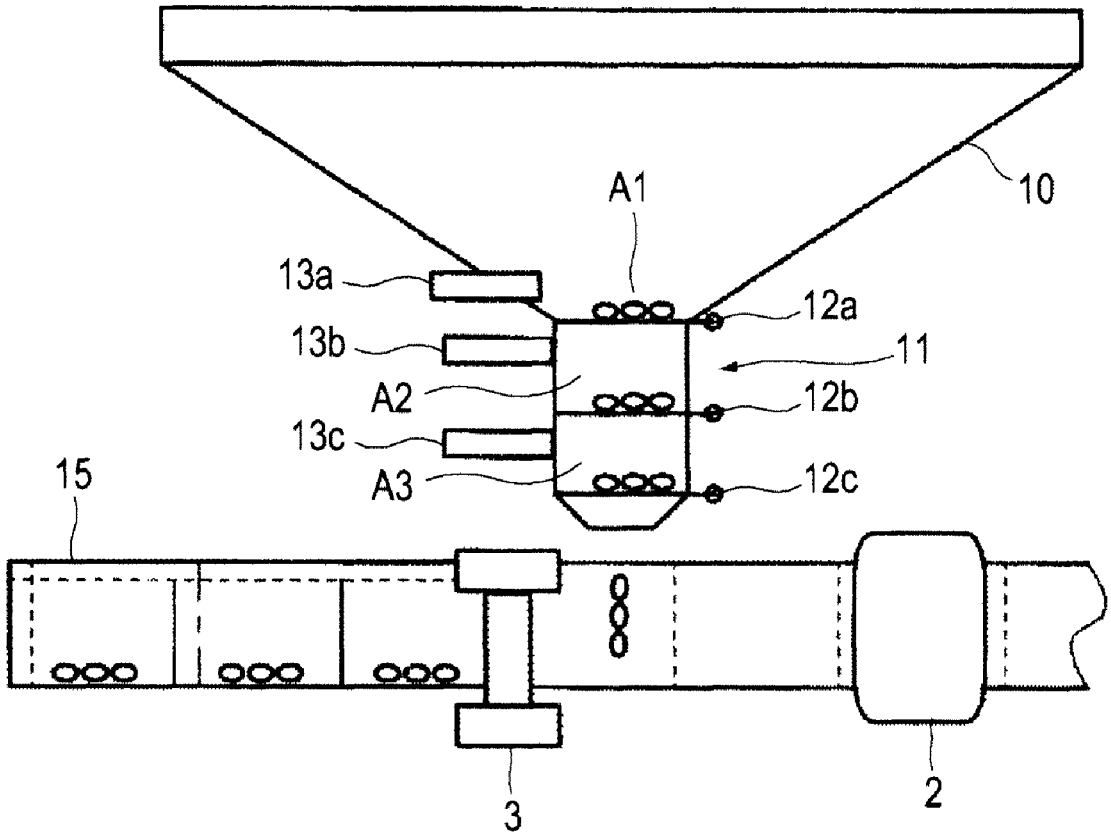
FIG. 2 is a partially enlarged view of FIG. 1.

As shown in FIG. 2, the tablet standby portion 11 includes three openable and closable shutters 12*a*, 12*b*, 12*c*, which are disposed vertically at predetermined intervals. Each of the shutters 12*a*, 12*b*, 12*c* provides a tablet standby area. Each of the tablet standby areas supports the tablets fed from the tablet supply unit 1 and has them stand by. (Hereinafter, such tablet standby areas are indicated as first, second and third tablet standby areas A1, A2, A3 in sequence from the uppermost one. Those tablet standby areas A1, A2, A3 correspond to the number of packagings in a packaging paper that is located between the printing unit 2 and the packaging unit 3. Particularly, in FIG. 5, since five packagings exist between the printing unit 2 and the packaging unit 3, five corresponding tablet standby areas become necessary.) The tablets supported by each of the shutters 12*a*, 12*b*, 12*c* are detected by each of the tablet detecting sensors 13*a*, 13*b*, 13*c*, which are positioned at each of the tablet standby areas A1, A2, A3. Further, the number of tablets is also counted. For example, an area sensor including a light-emitting element and a light-receiving element may be used as the tablet detecting sensors 13*a*, 13*b*, 13*c*.

A cross-sectional shape of the tablet standby portion 11 is not limited to a circular shape. It may have any shape such as a rectangle, a triangle, etc. The shutters 12*a*, 12*b*, 12*c* may be constructed in a slide or tilt manner. In case of the slide manner, any one of a reciprocally movable type and a pivotally movable type may be used in the same plane. In case of the tilt manner, a rotating shaft may be positioned centrally or at one end side. A motor, a solenoid, etc. may be used as a drive source for opening and closing the shutters 12*a*, 12*b*, 12*c*. To ensure fall of the tablets when the shutters 12*a*, 12*b*, 12*c* are opened, the opening and closing operations of the shutters 12*a*, 12*b*, 12*c* may be repeated or other oscillating mechanism may be used. Further, the tablet standby portions 11 may be constructed such that a plurality of tablet accommodating chambers are provided therein, and such that the tablets standing by in each of the tablet accommodating chambers can be fed sequentially by rotation. (For example, techniques disclosed in Japanese Patent Application Laid-Open No. (Hei)10-129603 and Japanese Patent Application Laid-Open No. 2000-325430 may be employed to the tablet standby portion 11.) Further, the kind of tablets may be identified by means of the tablet detecting sensors 13*a*, 13*b*, 13*c*. For example, a CCD (Charge Coupled Device), a CMOS (Complementary Metal Oxide Semiconductor) or the like may be used. Also, based on the images taken therefrom, a control section 19, which will be described below, may carry out a well-known image recognition process by means of software.

The printing unit 2 serves to print each medicine packaging of the packaging paper 15. A laser printer, an ink-jet printer, etc. may be used as the printing unit. Descriptions to be printed by the printing unit 2 contain a use-by date, a lot number, error information, etc. in addition to the contents of a prescription (e.g., dosage dates, a dosage method, a medicine name, efficacy, etc.). Printing begins when the relevant tablets are detected at the uppermost tablet standby area A1 by the tablet detecting sensor 13*a*.

Figure 5:
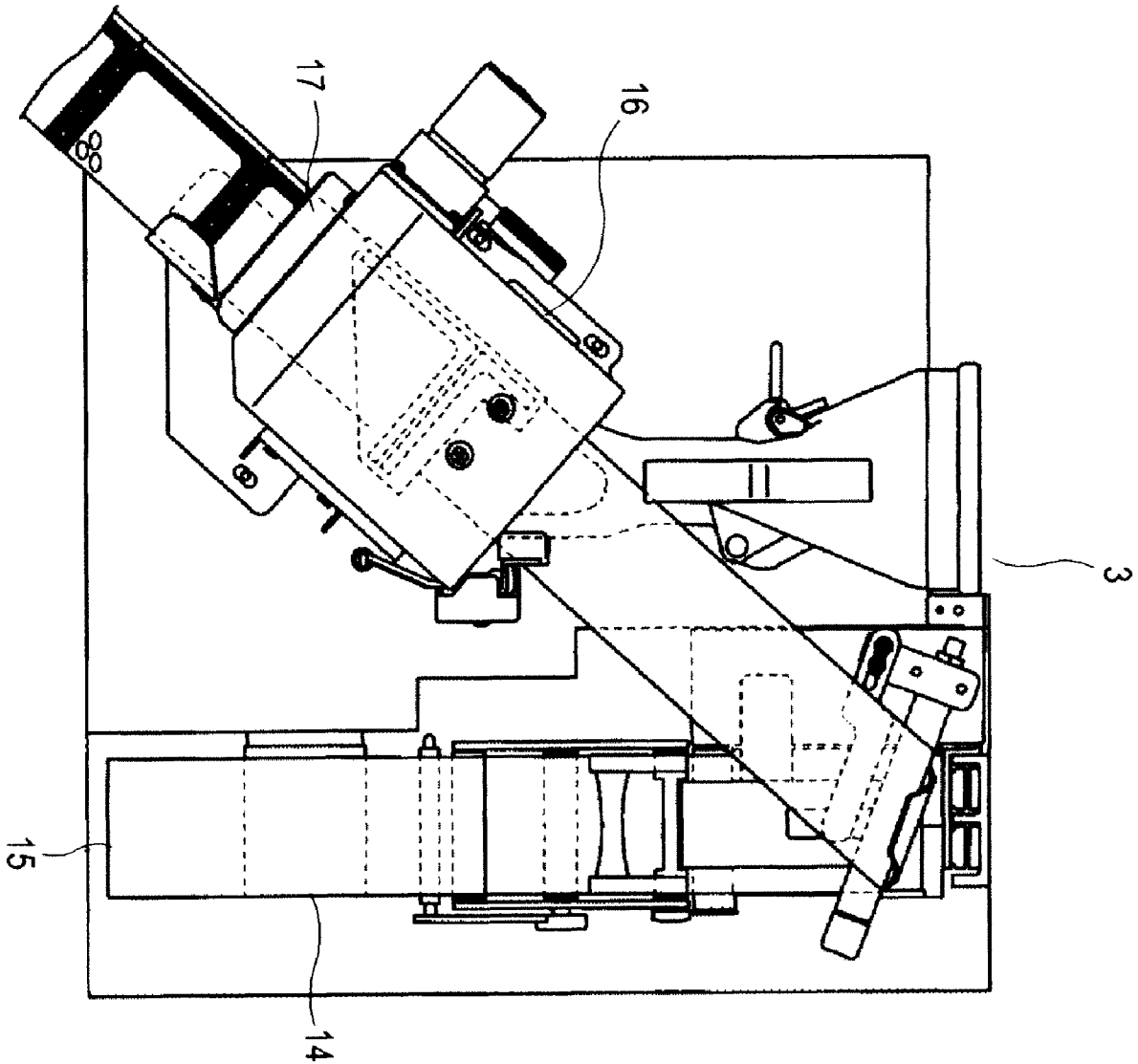
FIG. 5 is a front view of a packaging unit.

In the packaging unit 3, as shown in FIG. 5, the packaging paper 15 wound to a roll 14 is rewound and is folded in half along a conveyance direction and is sealed along the conveyance direction at a predetermined interval by means of a sealing member 16. Further, the packaging paper accommodates the tablets fed from the tablet supply unit 1 via the hopper 10 and then forms a bag shape by sealing a residual portion thereof. (More specifically, see Japanese Patent Application Laid-Open No. 2005-162240) Unlike FIG. 1, it is shown in FIG. 5 that the packaging paper 15 is conveyed obliquely and downwardly. However, FIG. 1 is merely a schematic diagram. Practically, the printing unit may be constructed as shown in FIG. 5. Further, conveying rollers (not shown) constitute a conveyance means to convey the packaging paper 15 from the printing unit 2 to the packaging unit 3. Also, a position where the tablets are fed to the packaging paper 15 is spaced apart from a printing position of the printing unit 2 by two packaging such that spacing corresponding to one packaging can be ensured. This avoids interference between the printing unit 2 and the packaging unit 3. Further, a serial body of medicine packaging, which is formed after the medicines are accommodated and packaged at the packaging unit 3, is cut off properly (e.g., per portion of one patient) by a cutter 17 disposed downstream of the packaging unit 3. Additionally, a roller type may be employed for implementing a sealing process in the packaging unit 3 (see, e.g., Japanese Patent No. 2942769).

Figure 6:
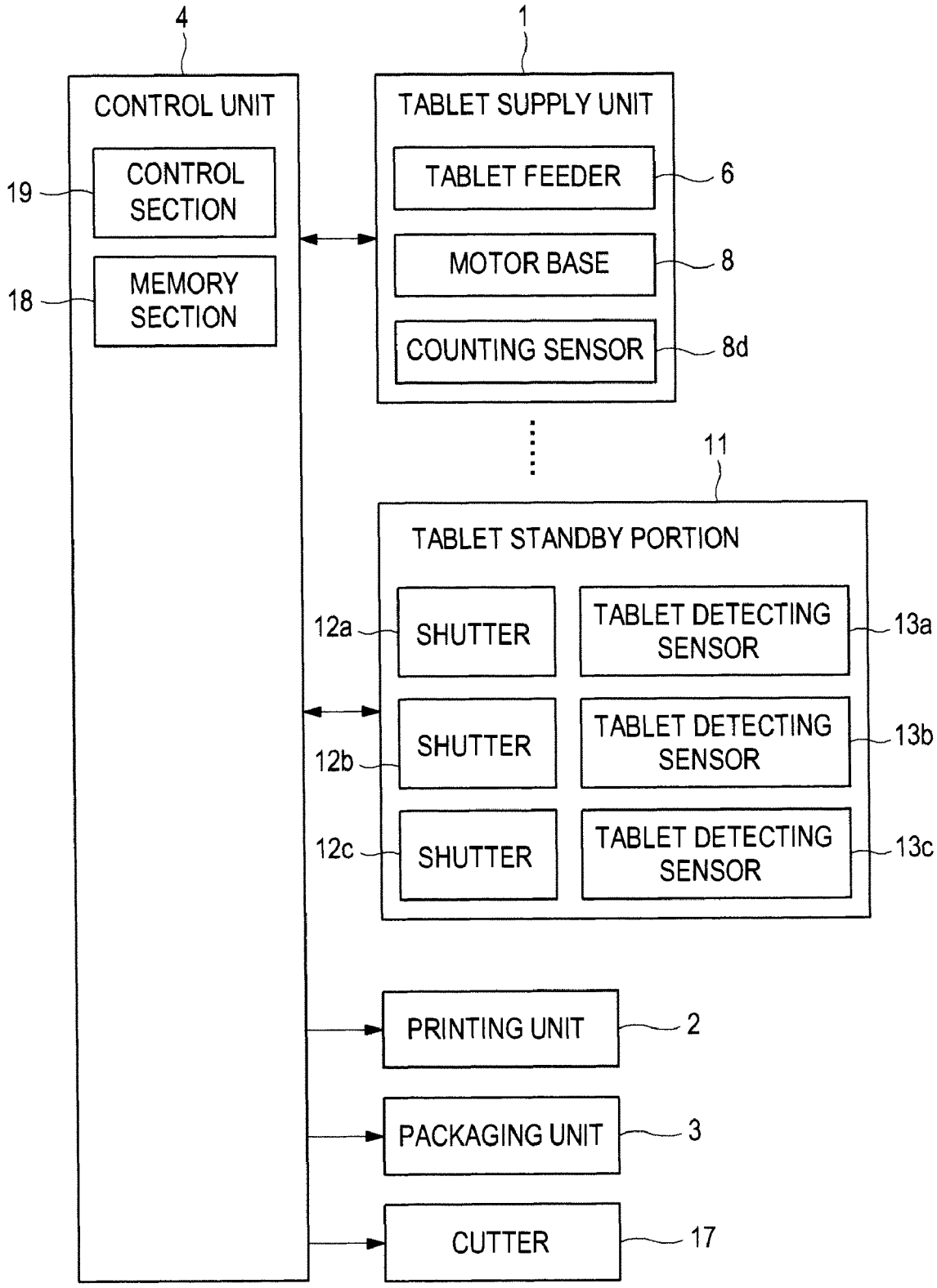
FIG. 6 is a block diagram of the tablet packaging apparatus according to one embodiment of the present invention.

As shown in FIG. 6, the control unit 4 includes a memory section 18 for storing at least a data table wherein each of the tablet feeders 6 and a kind of medicine accommodated in the tablet cassette 9 thereof are correlated. The remainder quantity of the tablets in each of the tablet feeders 6, a lot number, medicine codes and the like are stored in the data table. The data table may contain an image data of the medicine. A prescription data may be stored in the memory section 18 in such a manner that it is received from a server (not shown) or it is directly inputted through an input means such as a keyboard. Further, the prescription data may be read out from the server of the memory section 18 and then temporarily stored in a volatile memory such as a RAM (Random Access Memory) whenever required. Herein, when the prescription data is inputted from the server, the prescription data is stored in a RAM and the packaging process is performed. A prescription number is given to the prescription data per patient. Even when numerous medicines are prescribed for one patient, a single prescription number is given to the prescription data. It is sorted as a packaging data per dosage time period (e.g., after breakfast, lunch and dinner, before bedtime, etc.). For example, in case a prescription is made to any patient with a dosage time period wherein a medicine A and a medicine B are after breakfast, lunch and dinner and a medicine C is after dinner, a single prescription number for the medicines A, B and C is given and is treated as one prescription data. Also, the medicines A and B after breakfast and lunch and the medicines A, B and C after dinner are treated as one packaging data.

Further, the control unit 4 includes a control section 19. The control section performs processes such as dispensing the tablets in a predetermined quantity from the tablet feeder 6 accommodating the relevant tablets on the basis of the prescription data, allowing the printing unit 2 to print the packaging paper 15 based on the detection signals from the tablet detecting sensors 13*a*, 13*b*, 13*c*, etc.

Next, operations of the tablet packaging apparatus as constructed above will be described with reference to the flow charts shown in FIGS. 7 and 8.

First, as an initial operation (step S1), it is determined by means of each of the tablet detecting sensors 13*a*, 13*b*, 13*c* whether or not the remaining tablets exist in each of the tablet standby areas A1, A2, A3. If the remaining tablets exist, then all the shutters 12*a*, 12*b*, 12*c* are opened and packaging is performed at the packaging unit 3. In such a case, a description such as "discard," "error," etc. is printed by the printing unit 2 so that the packaged object can be identified at a glance as an abnormal one. When such processes are completed, the tablet standby portion 11 is compartmentalized by the shutters 12*a*, 12*b*, 12*c* to thereby form the tablet standby areas A1, A2, A3.

When the initial operation is completed and a prescription data is inputted from the server (step S2), the tablet feeder 6 that accommodates the relevant medicines therein is driven based on the prescription data (step S3). More specifically, the data table previously stored in the memory section 18 is referred to based on the medicine name contained in the prescription data and the tablet feeder 6 accommodating the relevant medicines is specified. Also, a dispensing process of the tablets begins by driving the motor 8*b* of the specified tablet feeder 6. At this time, the quantity of the tablets being dispensed is counted by the counting sensor 8*d* (step S4). In case several kinds of tablets are contained in one prescription, dispensing tablets is performed with respect to all of the tablet feeders 6 accommodating the relevant tablets.

Whether or not dispensing tablets is completed is determined by comparing the number of tablets contained in the prescription data with the number of tablets counted by the counting sensor 8*d* (step S5). Steps S4 and S5 are repeated until the count number from the counting sensor 8*d* equals the number of tablets in the prescription data. If the former equals the latter, then dispensing tablets is determined to be completed and next steps are carried out. The tablets dispensed from the tablet feeder 6 gather in the tablet standby portion 11 through the hopper 10. In the tablet standby portion 11, the tablets are held by the uppermost shutter 12*a*. The quantity of the tablets, which are held on the shutter 12*a*, is detected by the tablet detecting sensor 13*a*. Then, it is determined whether or not it equals the quantity counted by the counting sensor 8*d* (step S6). In such a case, ascertaining whether the dispensed tablet is the tablet included in the prescription data may be carried out by the image recognition process.

When the number of tablets detected by the tablet detecting sensor 13*a* equals the quantity detected by the counting sensor 8*d* (e.g., "YES" at step S6), the printing unit 2 begins to print the packaging paper 15 (step S7). The descriptions to be printed on the packaging paper 15 includes a dosage time period, a dosage method, a medicine name, a use-by date, a lot number, etc. As such, since the prescription number is checked before beginning to print the packaging paper 15, the printing can be stopped when the tablet feeder 6 is jammed by the tablets or when an erroneous counting occurs at the counting sensor 8*d*. In case the medicine cassette 9 runs short of the medicine during feeding the medicine and thus another medicine cassette 9 must feed the same medicine, a plurality of lot numbers may be printed.

Further, when the number of tablets to be detected by the tablet detecting sensor 13*a* does not reach the prescription number although the motor 8*b* is driven (e.g., "NO" at step S6), error information is written (step S8) and such error information is set as the description to be printed on the packaging paper 15 (step S9). Preferably, the error information represent error occurrence and additionally contain descriptions capable of specifying contents of the error (e.g., a patient name, etc.). In such a case, the prescription causing the error may be canceled.

However, the tablet detecting sensor 13*a* can be substituted by the counting sensor 8*d*. That is, the tablets to be dispensed may be identified based on only the count results from the counting sensor 8*d* under an assumption that the tablets dispensed from each of the tablet cassettes 9 can be dispensed without any jamming. In such a case, the judgment at the step S6 is no longer necessary. Instead, a decision on carrying out which one of the steps S7 and S8 may be made based on the judgment at the step S5.

In case of canceling the prescription, for example, medicines remaining in the tablet standby areas are discarded into a dustbox (not shown) and a cancel process is performed. The cancel process may be performed in such a manner that a cancel button is displayed on a display screen, which is touch-operated. Also, as for the canceled prescription, the dispensing process may be automatically resumed based on the written error information. In such a case, a mark, by which error information and re-dispensing can be identified, may be printed on the packaging paper. In case of marking, it is preferable that such a mark can be identified by only a pre-authorized inspector (e.g., a pharmacist).

Subsequently, the opening and closing operation of the shutters 12*a*, 12*b*, 12*c* at the tablet standby portion 11 is performed (step S10). As for the opening and closing operation of the shutters 12*a*, 12*b*, 12*c*, as shown in the flow chart of FIG. 8, it is first determined whether tablets are held in the third tablet standby area A3 (step S11). If held, the tablets fall to the packaging unit 3 by opening and closing the lowermost shutter 12*c* (step S12). Similarly, the middle shutter 12*b* is controlled and driven based on the presence or absence of tablets in the second tablet standby area A2 (step S13, step S14). Thereafter, the uppermost shutter 12*a* is opened and closed and the tablets held therein are moved to the second tablet standby area A2. After the above processes, the packaging paper 15 is conveyed by one packaging through controlling and driving the packaging unit 3 (step S16) so that the next packaging operation can be ready. In such a case, if the tablets can be conveyed to each of the tablet standby areas in sequence while the opening and closing operation of the shutters 12*a* to 12*c* is managed by a timer, then the tablet detecting sensors 13*b*, 13*c* can become unnecessary.

A section corresponding to one packaging, which is printed by the printing unit 2, is conveyed sequentially by one packaging and then accommodates the tablets in a position where it is moved by two packaging. Further, the first, second and third tablet standby areas A1, A2, A3 are formed in the tablet standby portion 11 by means of the shutters 12*a*, 12*b*, 12*c*. Also, the printed section of one packaging, which can be printed by the printing unit 2, a middle section after conveyance by one packaging and a packaging section after conveyance by further one packaging correspond to each of the first, second and third tablet standby areas A1, A2, A3, respectively. Accordingly, even when the printing operation is temporarily interrupted due to the error occurring during the above-described serial packaging processes, an appropriate packaging process can be performed again in resuming the operation since each packaging of the packaging paper 15 corresponds to each of the tablet standby areas A1, A2, A3.

If the shutters 12*a*, 12*b*, 12*c* are opened and closed in the tablet standby portion 11 and packaging of the tablets is performed in the packaging unit 3 as described above, then it is determined whether the prescription data contains the next packaging data (step S17). Where the next packaging data is contained, the processes of the steps S3 to S10 are repeated.

Figure 3:
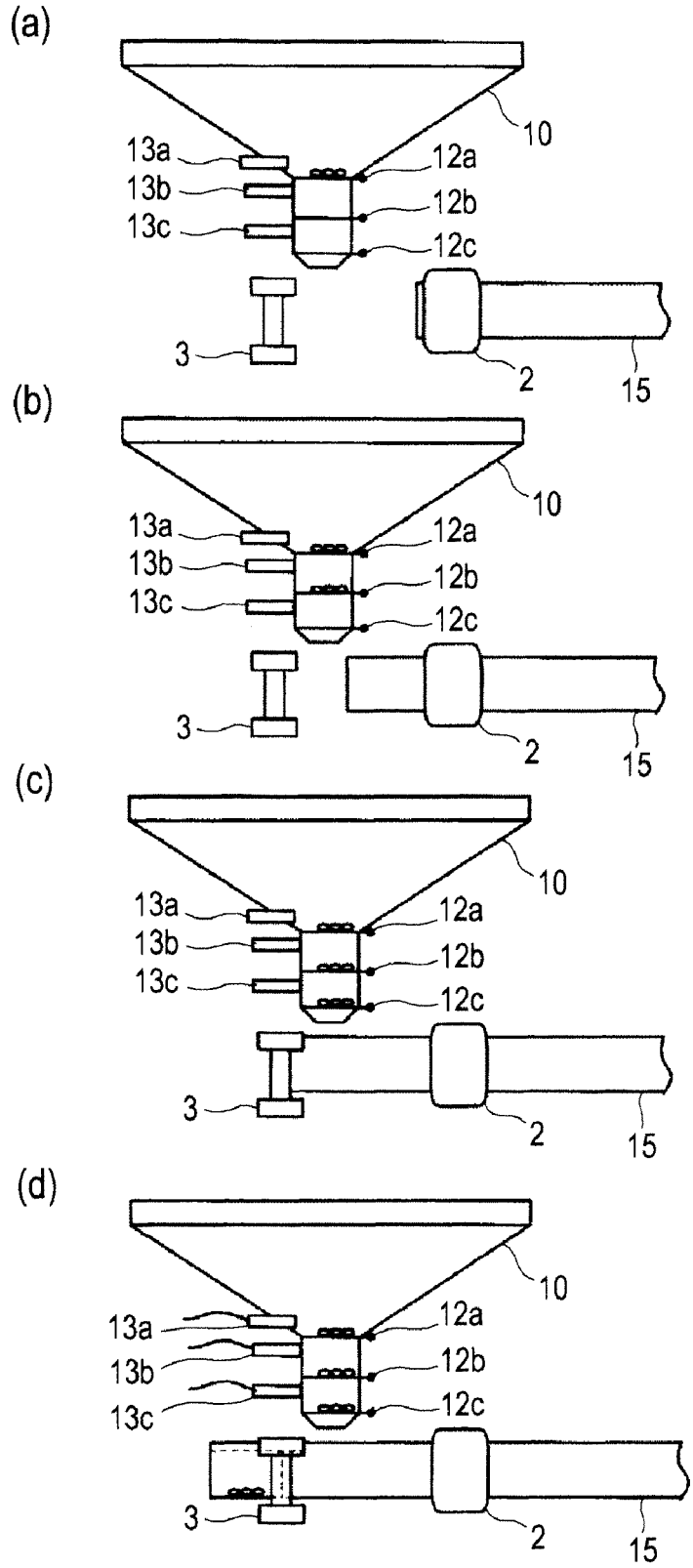
FIG. 3 schematically illustrates packaging and printing processes in accordance with the present invention.

In case tablets are fed from the tablet supply unit 1 when no tablets are held in the tablet standby portion 11, as shown in FIGS. 3(*a*) to 3(*d*), the tablets are downwardly moved in sequence. At the same time, the packaging paper 15, which has been printed by the printing unit 2, is conveyed by one pitch (e.g., by one packaging).

Thereafter, if each of the above-described processes is completed with respect to all of the packaging data contained in the prescription data (step S18), then the operation returns to the step S2 and waits for the input of next prescription data.

The process of feeding tablets, the printing process and the packaging process are repeated in an above-described manner based on the sequentially inputted prescription data. Also, the packaging paper 15 is cut off by the cutter 17 per one patient (e.g., per one prescription data) (step S19).

(Another Embodiment)

Figure 9:
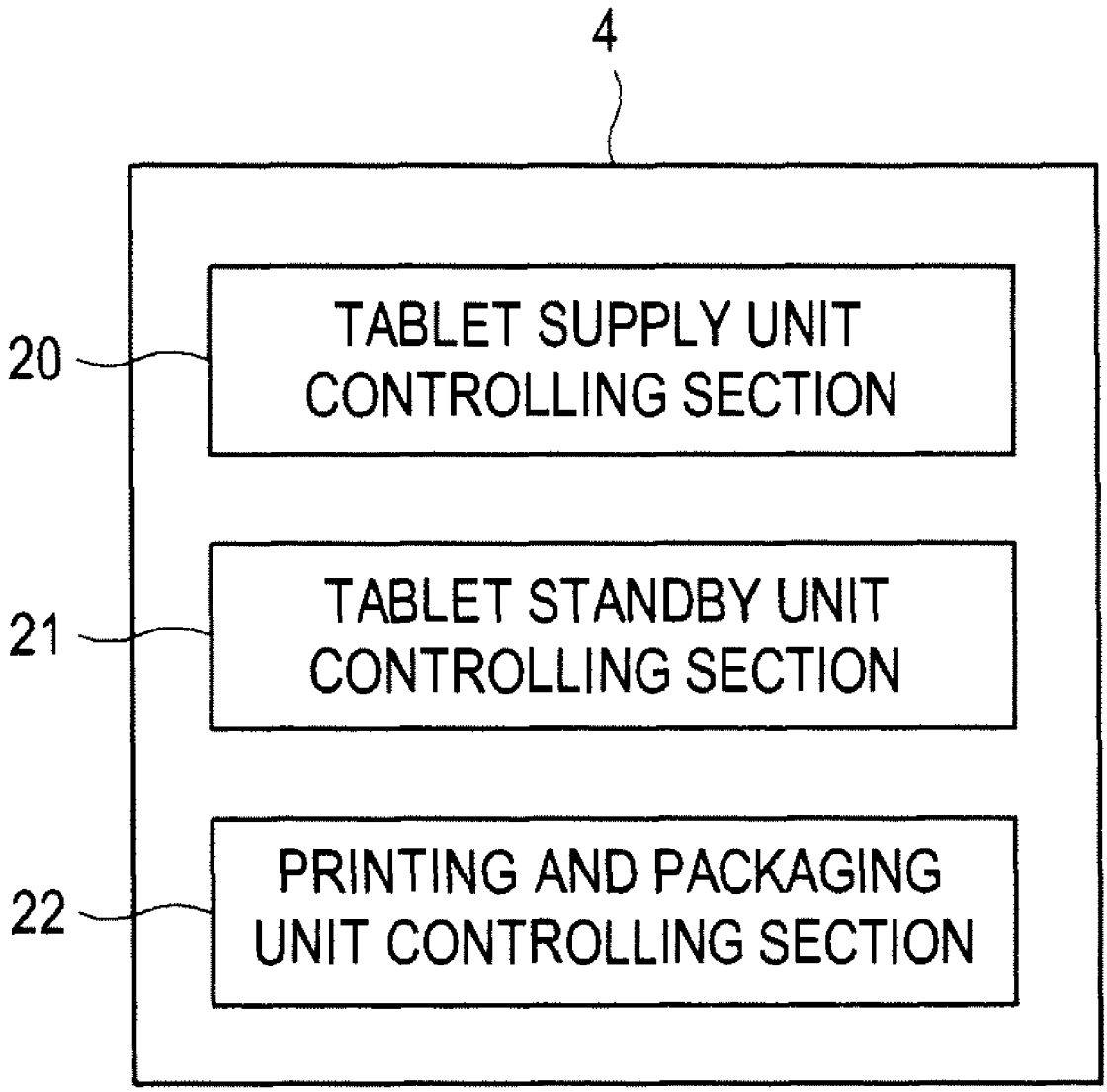
FIG. 9 is a block diagram illustrating a control section of a tablet packaging apparatus according to another embodiment of the present invention.

In another embodiment of the present invention, as shown in FIG. 9, the control unit 4 comprises a tablet supply unit controlling section 20, a tablet standby unit controlling section 21, and a printing and packaging unit controlling section 22.

The tablet supply unit controlling section 20 allows tablets to be dispensed from the corresponding tablet cassette 9 when the tablet standby portion 11 of a next process becomes vacant. Counting the tablets is carried out by the counting sensor 8*d* mounted to each of the tablet cassettes 9. In such a case, similar to the foregoing embodiment, the tablet detecting sensor 13*a* for identifying the tablets just prior to packaging can be substituted with the counting sensor 8*d*.

The tablet standby unit controlling section 21 has the medicines before packaging stand by in the tablet standby portion 11 having a plurality of tablet standby positions. It then conveys them to the packaging unit of a next process in a first-in-first-out manner. In such a case, if the tablets can be conveyed to each of the tablet standby areas in sequence while the opening and closing operation of the shutters 12*a* to 12*c* is managed by means of a timer, then the tablet detecting sensors 13*b*, 13*c* can become unnecessary. Further, the tablet standby portion 11 should not be limited to a configuration wherein a plurality of receiving chambers is vertically provided. It may include a rotary configuration. Also, the tablet standby portion 11 may be positioned at any place from the discharge passage to an input position to the packaging paper 15. Furthermore, the tablet standby portion 11 can be positioned at several places rather than at one place. The number of tablet standby positions in the tablet standby portion 11 needs to be equal to or more than the maximum number of packaging, which exist in a section ranging from the printing position of the packaging paper 15 to the packaging position. For example, when four packaging exist in said section, the number of tablet standby positions should be equal to or more than four.

The printing and packaging unit controlling section 22 is constructed to receive the completion of a discharging process of dispensing tablets from the tablet standby unit and then begins the printing process.

In an example where the control unit 4 is as described above, each controlling section independently performs its relevant process.

Figure 10:
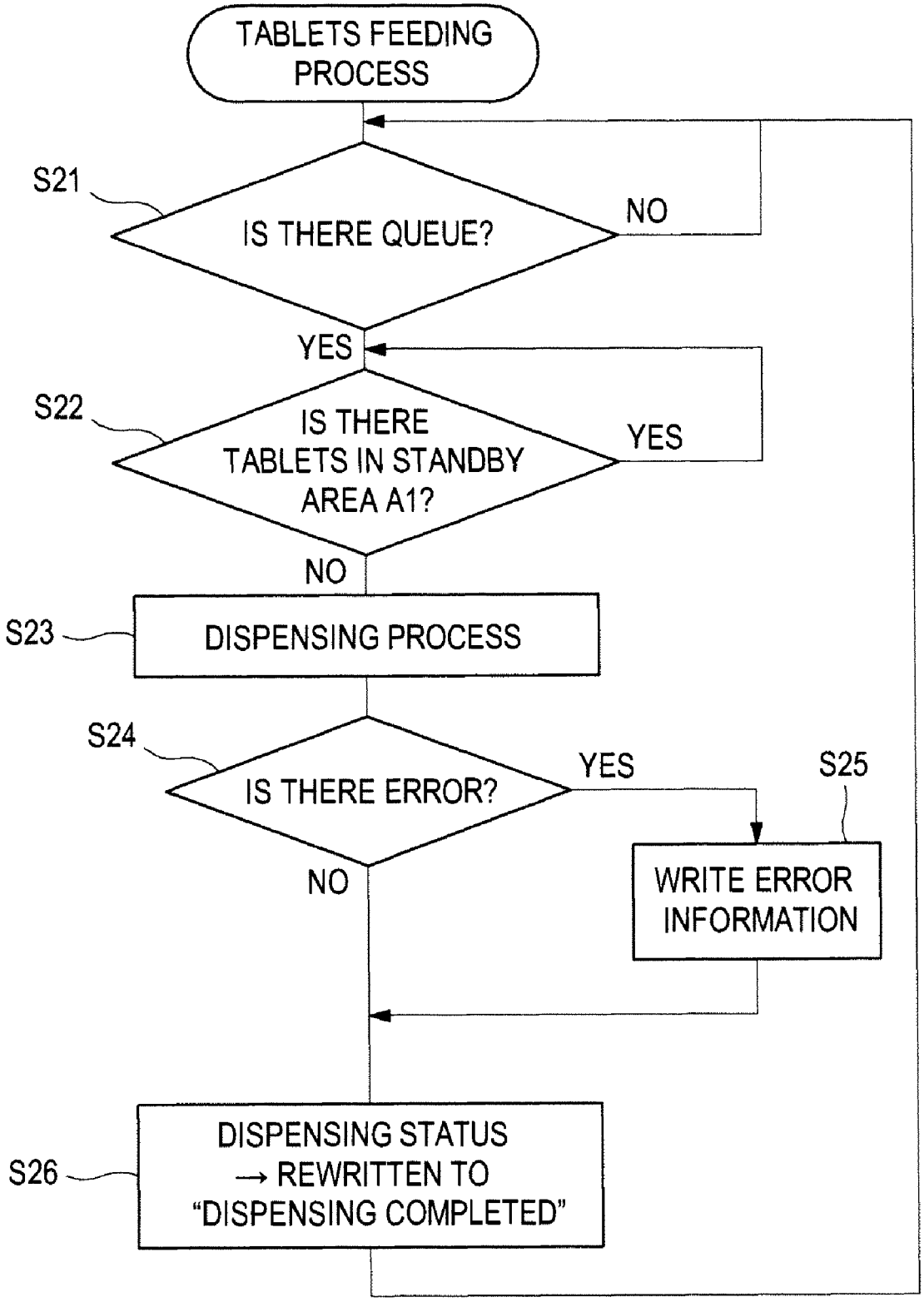
FIG. 10 is a flow chart showing control in a tablet supply unit controlling section of the tablet supplying apparatus according to another embodiment of the present invention.

The tablet supply unit controlling section 20 performs a dispensing process in accordance with a flow chart shown in FIG. 10.

When there is an unprocessed prescription queue (step S21), it is ascertained whether tablets relating to other prescription data remain in the tablet standby area A1 (step S22). If the tablets do not remain, then the dispensing process of the tablets begins (step S23). In the dispensing process, a dispensing status is rewritten to "Dispensing From Cassette." The dispensed tablets are counted by the counting sensor 8*d*. Also, whether an error occurs or not is determined based on whether the count result coincides with contents of the prescription (step S24). If no error occurs and the dispensing process is normally completed, then the dispensing status is rewritten to "Dispensing Completed" (step S26). At this time, a dosage time period, a dosage method, a medicine name, etc. are printed on the relevant medicine packaging of the packaging paper. On the other hand, if an error occurs, error information is written in association with the prescription (step S26) and the dispensing process progresses to the step S26 to rewrite the dispensing status to "Dispensing Completed." In such a case, the printed description is the error information.

Figure 11:
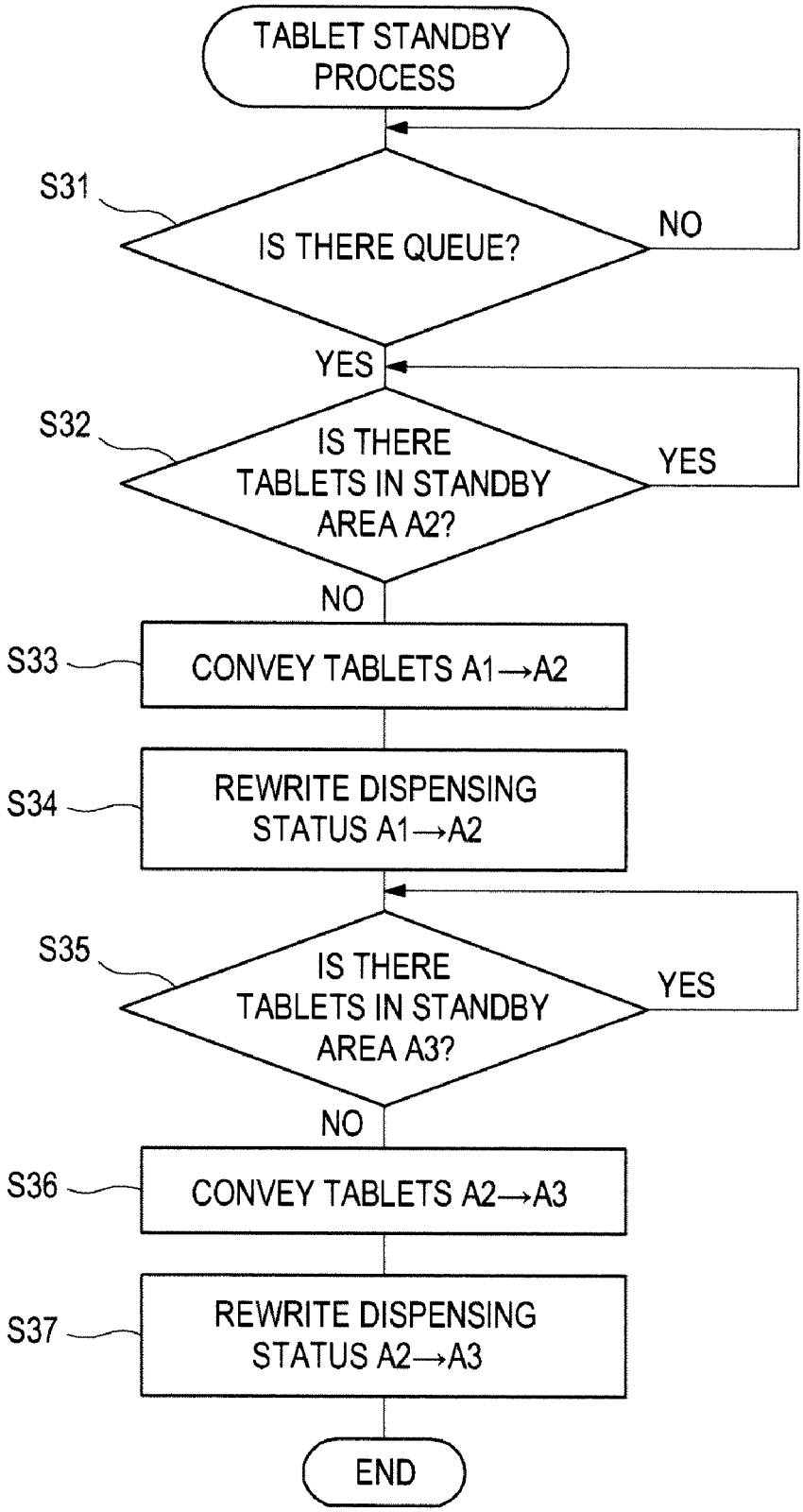
FIG. 11 is a flow chart showing control in a tablet standby unit controlling section of the tablet supplying apparatus according to another embodiment of the present invention.

The tablet standby unit controlling section 21 performs a standby process in accordance with a flow chart shown in FIG. 11.

When there is a prescription queue of "Dispensing Completed" (step S31), tablets in the tablet standby area A1 is conveyed to the tablet standby area A2 (step S33) under a condition that tablets relating to other prescription are absent in the tablet standby area A2 (step S32). Then, the dispensing status is rewritten from "Stand-by Area A1" to "Stand-by Area A2" (step S34). If the tablets are conveyed to the tablet standby area A2 under a condition that the tablets are absent in the tablet standby area A3 (step S35), then the tablets in the tablet standby area A2 are conveyed to the tablet standby area A3 (step S36) and the dispensing status is rewritten from "Stand-by Area A2" to "Stand-by Area A3" (step S37).

Figure 12:
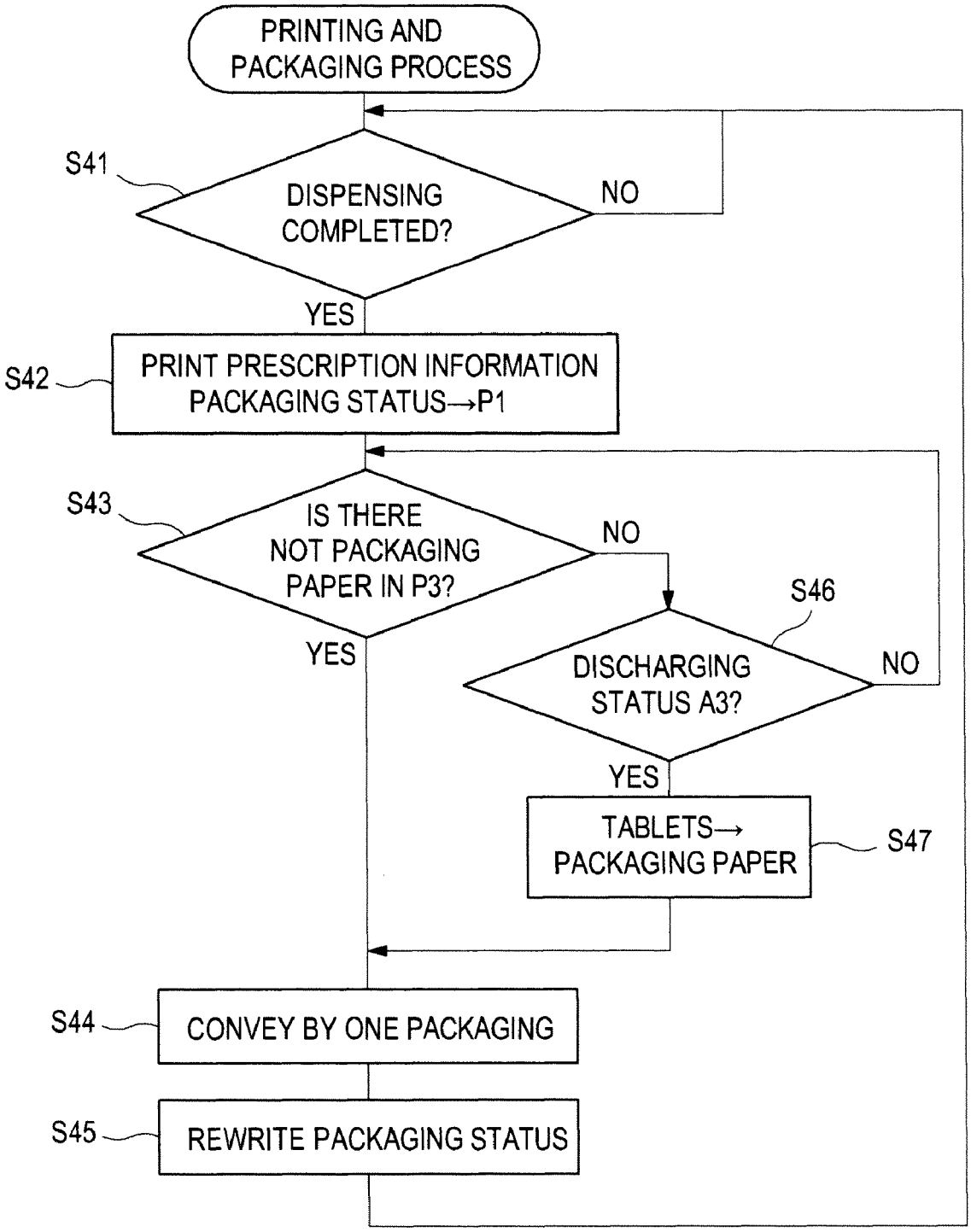
FIG. 12 is a flow chart showing control in a printing and packaging unit controlling section of the tablet supplying apparatus according to another embodiment of the present invention.

The printing and packaging unit controlling section 22 performs a printing and packaging process in accordance with a flow chart shown in FIG. 12.

It is ascertained that the dispensing status becomes "Dispensing Completed" (step S41) and the prescription information is printed on a relevant medicine packaging of the packaging paper 15 and a packaging status is rewritten to a printing position P1 (step S42). Also, it is determined whether a printed medicine packaging of the packaging paper 15 is positioned at a medicine input position (seal position) P3 (step S43). If the printed medicine packaging is thus positioned, then the packaging paper 15 is conveyed by one packaging (step S44) and the packaging status is rewritten (step S45). If the packaging status is the printing position P1, then it is rewritten to one packaging conveyance P2 (from the printing position). Further, if the packaging status is the one packaging conveyance P2, then it is rewritten to the medicine input position P3. Moreover, if the printed medicine packaging is not positioned at the medicine input position P3, then it is determined whether the dispensing status in the medicine input position P3 is "Stand-by Area A3" (step S46) before conveying the packaging paper 15 by one packaging at the step S44. If the dispensing status becomes into "Stand-by Area A3," then the shutter is opened and closed and the tablets are inputted into the packaging paper (step S47). At this time, similar to the foregoing embodiment, it is ascertained whether the medicines to be inputted and the medicine packaging of the packaging paper 15 to be inputted match each other.

As such, in the second embodiment, each of the controlling sections independently performs each of the dispensing process, the standby process, and the printing and packaging process. Accordingly, a control program can be programmed with ease, and thus, flexible measures can be taken for error occurrence.

In the foregoing embodiments, descriptions have been made with respect to the packaging of tablets. However, the same structure as the tablet standby portion 11 having a plurality of shutters 12*a*, 12*b*, 12*c* may be employed for packaging other types of medicines such as capsular medicines.

Further, in the foregoing embodiments, the shutters 12*a*, 12*b*, 12*c* are disposed in the opening of the lower end portion of the hopper 10. However, a storing portion located at a lower side of the drum 5 can be configured in a similar manner (see Japanese Patent No. 2768614). That is, at a lower end portion, there is provided a storing portion for temporarily storing tablets discharged from the tablet feeder 6 and then falling through the guide passage 7. The storing portion may be configured such that a lower end portion of the guide passage is inwardly slanted and a ring-shaped bottom plate 11 is disposed at the lower end portion. Through-holes are formed at the bottom plate 11 at the same pitch as that of the guide passages 7. Also, the opening of the lower end portion of the guide passage 7 is opened and closed by rotating the bottom plate 11 by a half pitch through means of a drive device such as a motor (not shown).

Figure 7:
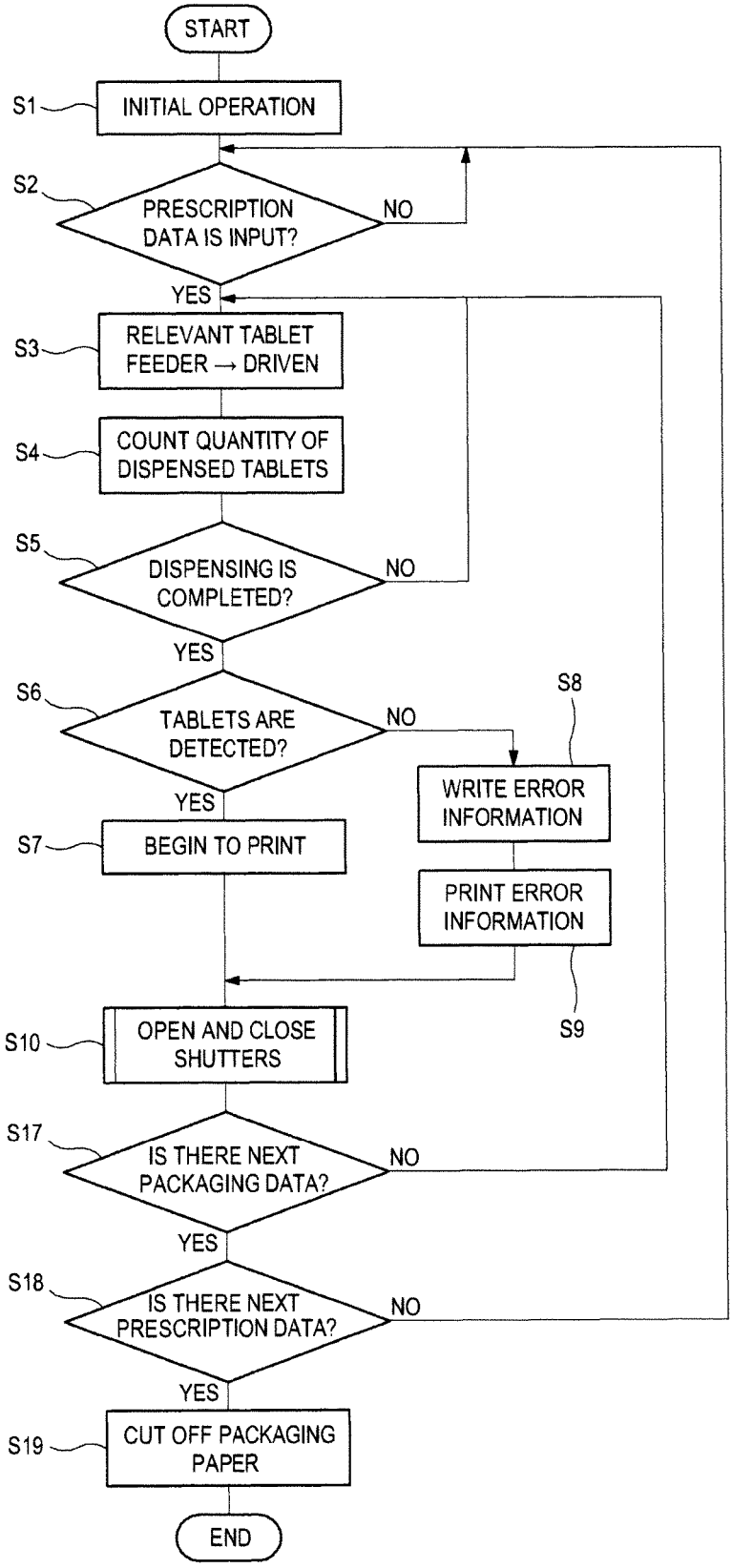
FIG. 7 is a flow chart showing operations of the tablet packaging apparatus according to one embodiment of the present invention.
Figure 8:
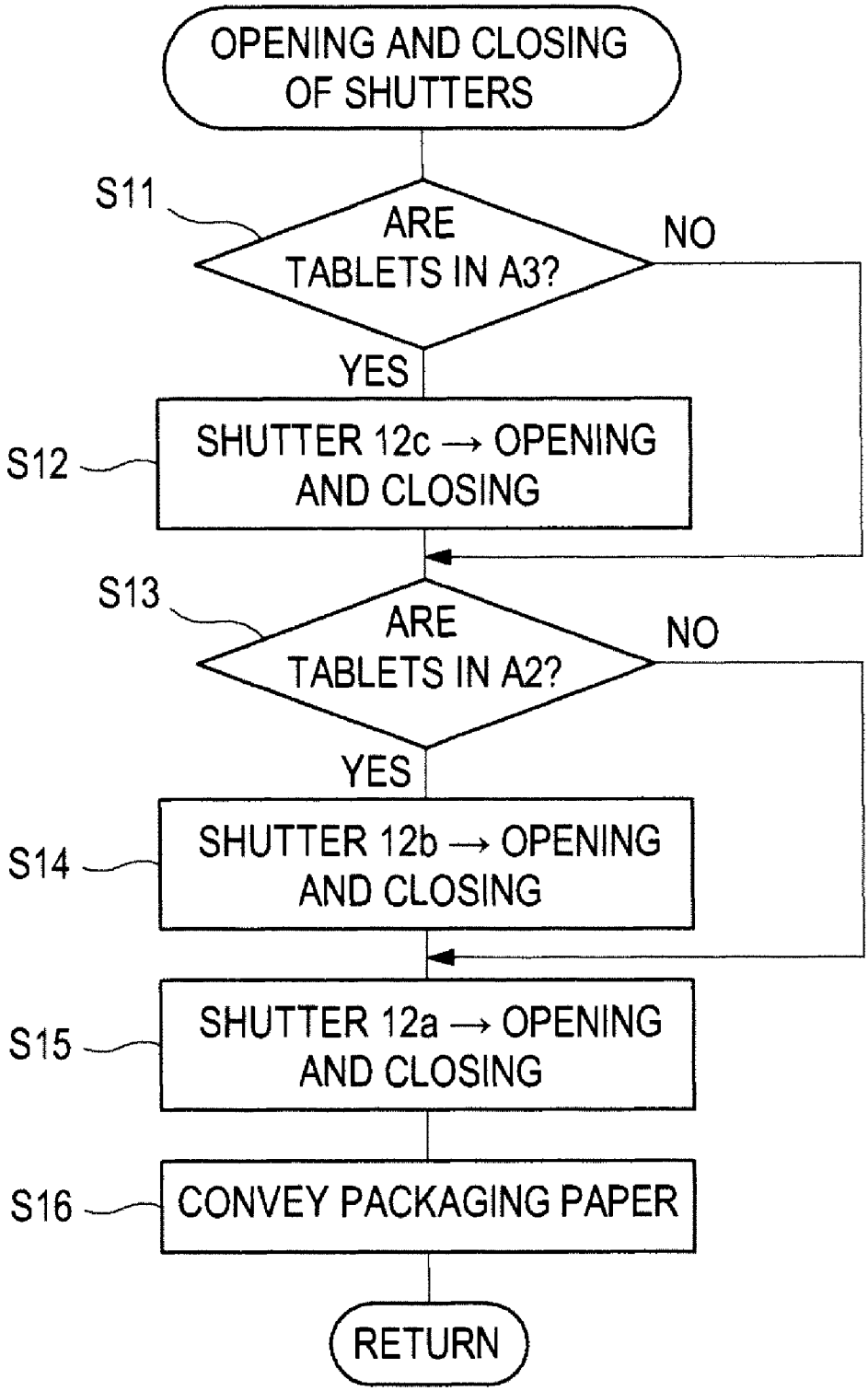
FIG. 8 is a flow chart showing a shutter opening and closing process shown in FIG. 7.

Further, in the former embodiment, whether or not to begin printing is determined at the step S6 of the flow chart shown in FIG. 7 depending on whether or not the tablets are detected. Thus, there is a need to provide as many medicine standby areas as the number of packaging existing between the printing unit and the packaging unit. On the other hand, in the latter embodiment, each of the controlling sections independently performs its own process. As such, medicine standby areas equal to or more than packaging existing between the printing unit and the packaging unit can be provided. Accordingly, a packing mechanism illustrated in Japanese Patent No. 2942769 can be utilized.

The invention claimed is:

1. A medicine packaging apparatus, comprising:

a medicine supply means for supplying a medicine according to a prescription data;

a medicine standby means for temporarily holding the medicine supplied by the medicine supply means and having the medicine stand by;

a printing means for printing a relevant data on a packaging paper according to the prescription data;

a packaging paper conveyance means for conveying the packaging paper;

a medicine packaging means for packaging the medicine supplied by the medicine supply means into the packaging paper in a packaging position; and a control means for allowing the packaging paper conveyance means to convey a relevant portion of the packaging paper, on which the relevant data is printed by the printing means, to the packaging position and allowing the medicine packaging means to package the corresponding medicine standing by in the medicine standby means, wherein the medicine standby means includes a passage opening and closing means for opening and closing a medicine passage extending from the medicine supply means to the medicine packaging means at any position, wherein the medicine supply means includes:

medicine accommodating portions, each of the medicine accommodating portions configured to accommodate one kind of a medicine; and a medicine collecting portion configured to collect the medicines supplied from each of the medicine accommodating portions to one place, and wherein the passage opening and closing means is provided at the medicine collecting portion, wherein the apparatus further comprises a memory means for storing a data correlating to a position information of each of the medicine accommodating portions and a medicine information of the medicine accommodated in each of the medicine accommodating portions, wherein the medicine information includes lot numbers inherent to the medicines accommodated in the medicine accommodating portions, and wherein the control means specifies the medicine accommodating portion accommodating the relevant medicine with reference to the data of the memory means based on the prescription data and begins supply of the medicine while allowing the printing means to print the lot number of the medicine on the packaging paper.

2. The medicine packaging apparatus of claim 1, wherein the apparatus further comprises a medicine detecting means for detecting the medicine supplied to the medicine standby means by the medicine supply means, wherein the memory means further stores an error information, and wherein the control means allows the printing means to print the error information on the packaging paper when the medicine based on the prescription data is not detected by the medicine detecting means.

* * * * *